United States Patent [19]

Luther

[11] Patent Number: 4,733,418

[45] Date of Patent: Mar. 29, 1988

[54] BATHING APPARATUS

[75] Inventor: Henry D. Luther, Massillon, Ohio

[73] Assignee: Enabling Devices, Inc., Massillon, Ohio

[21] Appl. No.: 856,005

[22] Filed: Apr. 25, 1986

[51] Int. Cl.[4] ..... A47K 3/12

[52] U.S. Cl. ..... 4/562; 4/563; 4/561; 4/566

[58] Field of Search ..... 4/563, 562, 578, 564, 4/566, 559

[56] References Cited

U.S. PATENT DOCUMENTS

| | | | |
|---|---|---|---|
| 424,730 | 4/1890 | Schoonmaker | 4/578 |
| 2,664,142 | 12/1953 | Scheuerman et al. | 4/578 |
| 3,413,662 | 12/1968 | Stayton | 4/562 |
| 3,714,672 | 2/1973 | Condon | 4/563 |
| 3,815,163 | 6/1974 | Sullivan | 4/562 |
| 3,889,304 | 6/1975 | Loren | 4/563 |
| 3,918,108 | 11/1975 | Feyerherm | 4/563 |
| 3,994,030 | 11/1976 | Cassell et al. | 4/563 |
| 4,206,523 | 6/1980 | James | 4/562 |
| 4,255,823 | 3/1981 | Boyer et al. | 4/562 |
| 4,624,019 | 11/1986 | Pennington-Richards | 4/562 X |

FOREIGN PATENT DOCUMENTS

| | | | |
|---|---|---|---|
| 02721 | 8/1983 | PCT In'l Appl. | 4/563 |

*Primary Examiner*—Henry K. Artis

*Attorney, Agent, or Firm*—Daniel J. Hudak

[57] ABSTRACT

An apparatus for assisting a handicapped or physically impaired person into and out of a bathing receptacle contains a stanchion mounted independently of the receptacle, a seat which is pivotably attached to the stanchion and a leg support. The stanchion contains a hydraulic cylinder for raising and lowering the seat. The leg support can also be elevated or retracted. The entire apparatus is foldable and can thus be stored out of the way when not in use.

8 Claims, 4 Drawing Figures

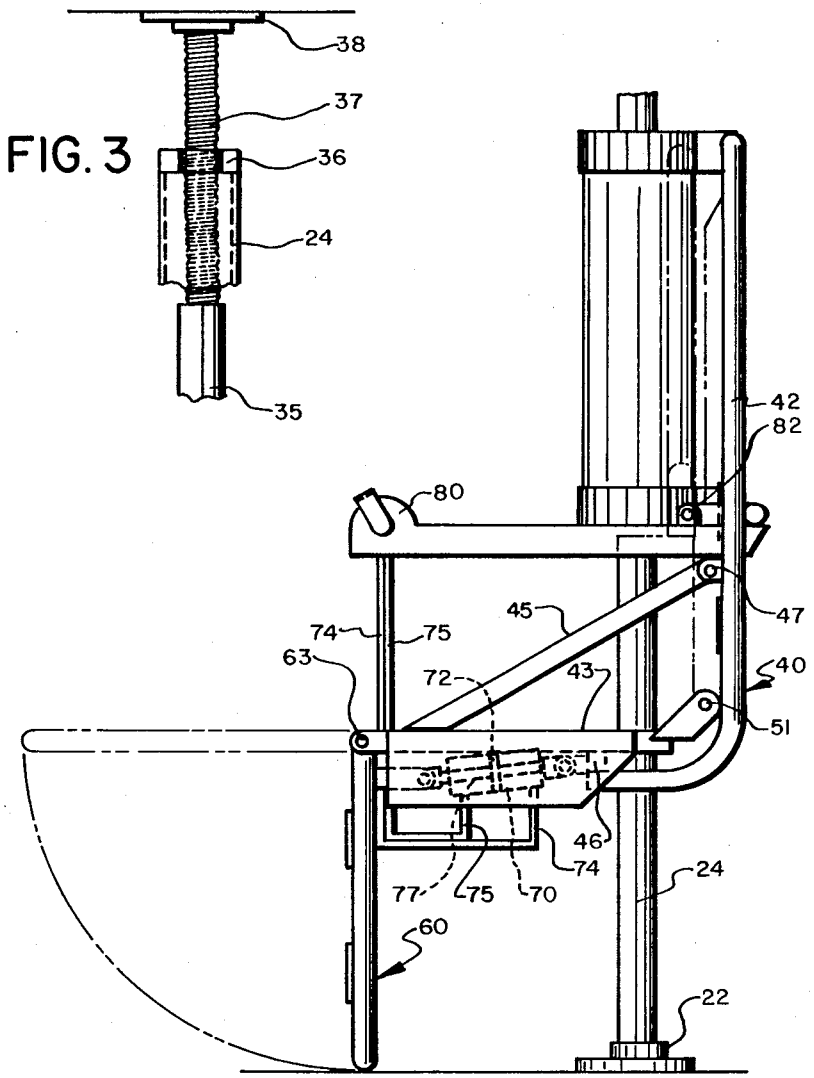
FIG. 3
FIG. 2
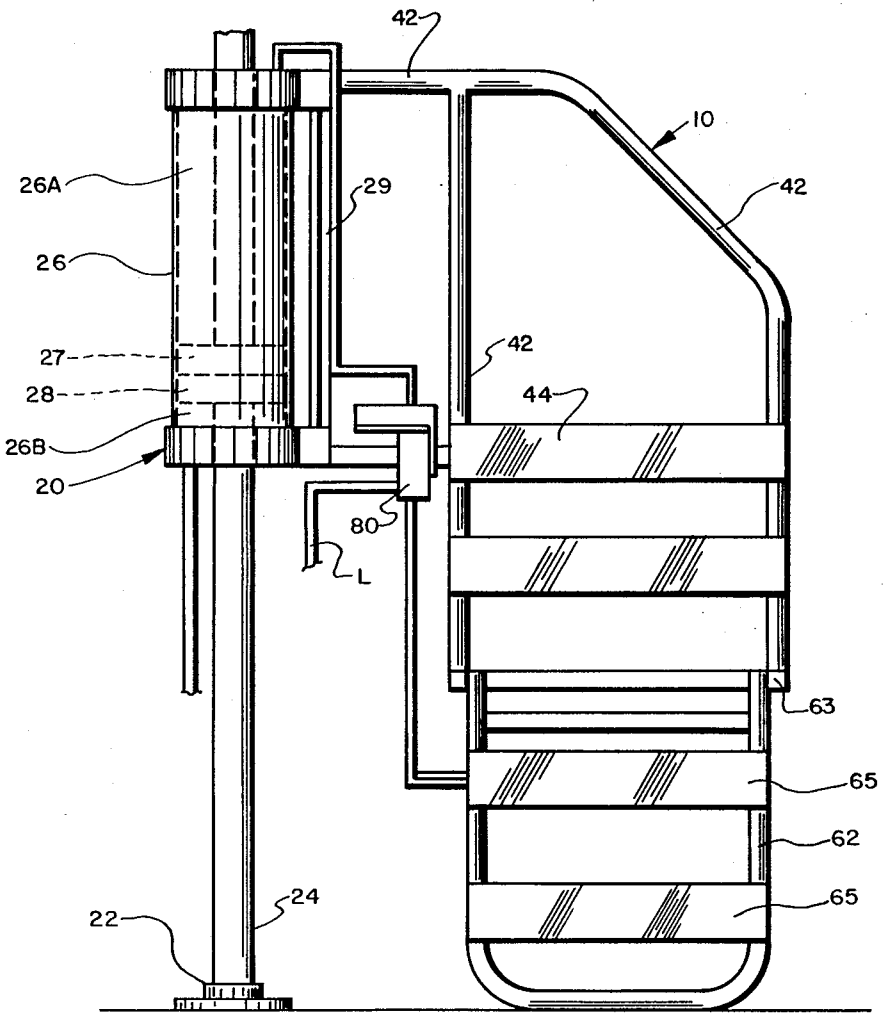
FIG. 1

BATHING APPARATUS

FIELD OF THE INVENTION

The present invention relates to an apparatus containing a seat and a leg support for lifting a handicapped or a physically impaired person into and out of a bathing receptacle such as bathtub, a therapy pool, and the like. More specifically, the present invention relates to a foldable bathing apparatus which is completely powered by water pressure and wherein movement of the apparatus is controlled through a master control switch.

BACKGROUND

Many persons have physical disabilities of various types that cause them to loose strength in their arm and leg muscles. Such persons often have difficulty of getting into and out of a bathtub to bathe. These persons usually require the assistance of another person. Due to the high sidewall of the bathtub and lack of full coordination of the physically impaired person, the act of entering and leaving a bathtub is still difficult and injury can occur.

Heretofore, various devices have been patented for assisting handicapped or physically impaired persons into and out of bathtubs. For example, U.S. Patent No. 3,714,672 to Condon relates to a device having a seat which is pivotably mounted to a frame. Through a hydraulic mechanism, the seat can be raised or lowered into a bathtub. The seat moreover is pivotal with regard to movement over and away from a bathtub.

U.S. Pat. No. 3,889,304 to Loren relates to a bathing device for invalid persons. The device contains a seat which can be swung from aside a bathtub to a position over the bathtub. The seat furthermore can be raised or lowered as can the entire bathtub.

U.S. Pat. No. 3,918,108 to Feyerherm relates to a portable bath lift having a hydraulic means which is securely fastened to a bathtub. A seat is swingably mounted to move from a position aside the bathtub to a position over the bathtub. The seat can be raised or lowered and contains a footrest.

U.S. Pat. No. 3,994,030 to Cassell, et al relates to bath seat lift wherein a hydraulic post is fastened to a bathtub to provide vertical movement of a seat attached thereto. The seat is also pivotally attached to the hydraulic post.

A common disadvantage of such prior art devices is a suitable leg support for raising or lowering a persons legs or a stanchion which is mounted separate and independently of a bathtub is not provided. A further disadvantage is that the prior art devices interfere with the normal use of the bathing device.

SUMMARY OF THE INVENTION

Therefore, it is an aspect of the present invention to provide a bathing apparatus for moving a person into and out of a bathing receptacle.

It is further aspect of the present invention to provide a bathing apparatus, as above, which generally fits any type of bathing receptacle and can be mounted independently thereof, and is conveniently folded up and swung out of the way by pivoting the apparatus about the stanchion.

It is a still further aspect of the present invention to provide a bathing aparatus, as above, which moves a person's body from outside the bathing receptacle to a position over the receptacle as well as to lower the person therein.

It is a still further aspect of the present invention to provide a bathing apparatus, as above, which is capable of elevating a person's legs before placing the person in the bathing receptacle.

It is a still further aspect of the present invention to provide a bathing aparatus, as above, wherein a single control governs the lowering and raising of a person's body as well as elevating and lowering a person's legs.

These and other aspects of the present invention will become apparent from the specification.

In general, a bathing aparatus for moving a person into and out of a bathing receptacle; comprising:

a stanchion, said stanchion mounted independently of said bathing receptacle, a seat assembly, said stanchion having a means for raising and lowering said seat assembly.

BRIEF DESCRIPTION OF THE DRAWINGS

FIG. 1 relates to a front plan view of a bathing apparatus according to the present invention.

FIG. 2 relates to a side elevation view of the apparatus.

FIG. 3 relates to a detailed view of the ceiling connection.

DETAILED DESCRIPTION

Figure 4:
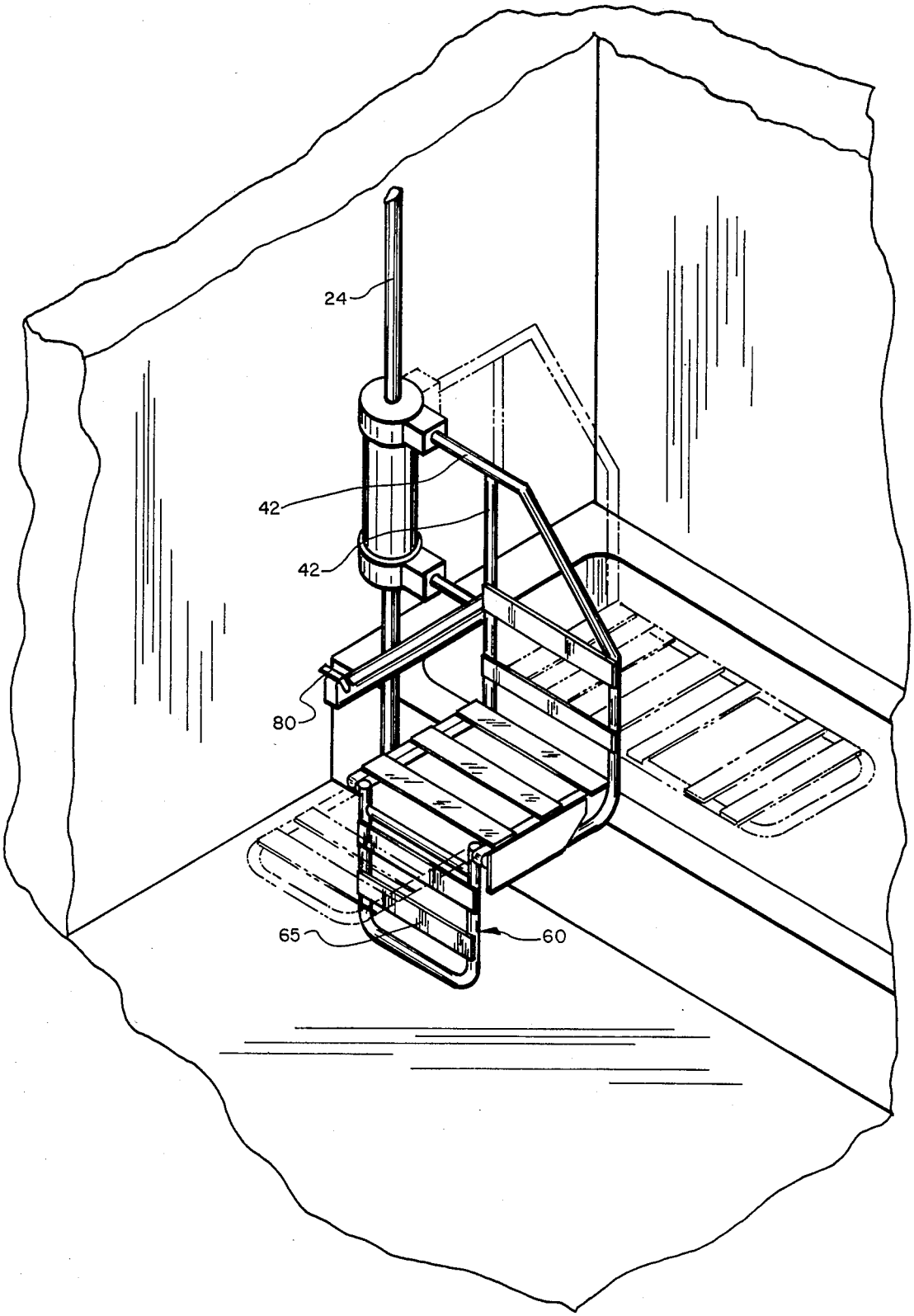
FIG. 4 is a perspective view of the apparatus of the present invention located adjacent to a bathtub.

The foldable bathing apparatus of the present invention is generally indicated by the numeral 10. The apparatus contains a stanchion 20, a seat assembly 40, and a leg support 60, all operated by master control switch 80. The stanchion is located independently of any conventional bathing receptacle such as a bathtub, therapy pool, or the like. That is, it is not mounted, attached, or affixed to the bathing receptacle but is spaced apart therefrom.

As shown in FIG. 1, stanchion 20 can be mounted on a substrate such as a bathroom floor. Accordingly, floor support and bracket 22 can be fastened to a floor in any conventional manner. A stanchion post 24 extends from the floor bracket and has a hydraulic cyclinder 26 attached thereto. The hydraulic cylinder can be separate from the stanchion or integral therewith as shown in FIG. 1. The hydraulic cyclinder is connected to seat frame 42 so that upon raising or lowering of the hydraulic cylinder, the seat assembly is also raised or lowered therewith. Hydraulic cylinder 26 can generally be any conventional hydraulic cylinder known to the art as well as to the literature. In the particular embodiment shown, the hydraulic cylinder has a piston 27 located within the cylinder housing. Piston 27 can be located at any suitable or desired height upon stanchion post 24 by adjustable clamp 28. Thus, should a bathing device be utilized which has a low sidewall such as sunken bathtub, clamp 28 can be positioned on the lower portion of stanchion post 24. Should an old-fashioned high sidewall bathtub be utilized, clamp 28 can be moved to the central portion or even to the upper portion of the stanchion post. Clamp 28 can be any conventional adjustable clamp known to those skilled in the art as well as to the literature. Piston 27 separates the hydraulic cyclinder into upper barrel portion 26A and lower barrel portion 26B.

The bathing apparatus of the present invention is completely powered by a fluid such as water. No electrical components are utilized. Water pressure can be obtained by connecting a single line L to the input line of a water closet through a suitable or conventional fitting (not shown). Line L is connected to master control switch 80 as shown in FIG. 1. In order to cause the seat assembly to rise in elevation, the master control switch is turned to an appropriate setting thereby permitting water pressure from line L to enter upper fluid line 29 which is connected to the upper portion 26A. The water pressure exerts pressure on the stationary piston and causes the hydraulic fluid cylinder as well as the attached seat assembly to rise. Whenever it is desired that the seat assembly should be lowered, master control switch 80 is moved to another position whereby the water pressure to fluid line 29 is terminated. Through the force of gravity, hydraulic cylinder 26 will be lowered whereby water in upper barrel portion 26A is forced out of the cylinder via fluid line 29. Lower barrel portion 26B is vented to the atmosphere.

The upper portion of free standing stanchion 20 is connected to a ceiling as through ceiling plate 38. Rod 37 which generally is threaded at one end contains adjusting nut 36 thereon. The remaining end of rod 37 has a projection 35 thereon such as a cylinder guide which engages the stanchion post. Cylinder guide 35 can be made to reside within the upper portion of stanchion post 24 in any common or conventional manner. Through rotation of adjustment nut 36, the stanchion can be securely and tightly fitted to a ceiling. Ceiling plate 38 can furthermore be securely fastened to the ceiling or a ceiling joist thereabove as through the use of screws or bolts.

The seat asssembly of the bathing apparatus is generally indicated by the numeral 40. The seat assembly has frame 42 which generally extends laterally of the position to be occupied by a person. The frame can be made of any conventional material and desirably is resistant to rusting. Hence, the frame can be made of rust resistant metals such as aluminum, stainless steel, and the like. Frame 42 is pivotably attached to stanchion 20 about a vertical axis. More specifically, the vertical axis can be hydraulic cylinder 26, or a housing portion thereof as shown in FIG. 1. Frame 42 is thus separate and spaced apart from the stanchion. Frame 42 which can be "L" shaped has a seat bottom portion 43. For the convenience of an individual, the seat bottom can contain a soft pliable material such as urethane foam, rubber, or the like mounted upon a solid support, e.g. metal or wood. Similarly, seat back rest portion 44 can be made of any suitable and desirably water resistant material such as that utilized with seat bottom 43. Arm rest 45 is pivotably attached through pivot pin 47 to the back portion of the seat frame. Arm rest 45 thus serves as an arm rest as well as a device to maintain a person or individual within the central portion of the seat assembly and yet can be raised up and out of the way as when an individual is getting on or off of seat assembly 40.

Seat bottom portion 43 can be non-integral with frame 42 as shown in FIG. 2. In this embodiment, seat bottom 43 is attached to frame 42 through seat pivot pin 51. Seat bottom portion 43 is thus foldable as will be more fully explained hereinbelow. Proper alignment of seat 43 can be obtained in any suitable manner such as through the utilization of a seat bottom stop 46 which engages frame 42.

Seat assembly frame 42 can be attached to the hydraulic cylinder in any conventional manner. It is an important aspect of the present invention however that seat assembly 40 be pivotable about the stanchion through a generally vertical axis. This can be accomplished in a manner as noted above. That is, seat assembly 40 can be pivotably attached to hydraulic unit as through a pin and aperture connection 48. The pivotal attachment of seat assembly 40 thus allows a person to be seated upon the bathing assembly outside the bathing receptacle. The seat assembly can be then manually swung to a position above the bathing receptacle and then lowered into place. The reverse process is followed to permit a person to exit from the bathing receptacle and the bathing apparatus. It is a desired aspect of the present invention that seat assembly 40 be manually pivotable to allow the bather or another person to move the seat assembly once the bather has been properly seated.

The leg support is generally indicated by the numeral 60. It is an important aspect of the present invention to provide such a leg support to assist the handicap or physically impaired to enter or leave a bathing receptacle. The leg support of the present invention upon operation of master control switch 80 will raise the legs of the person so that they are in a horizontal position and thus enter the bathing receptacle in such a position. The leg support also acts as a safety feature since it keeps the legs of a handicapped or physically impaired person away from the bathing receptacle sidewall.

The leg support contains a leg frame 62 which is attached to seat assembly 40 through leg pivot pins 63. As best shown in FIG. 1, the leg frame is traversed with one or more leg rest portions 65 which can be made of any suitable material such as rubber or plastic, wood or steel and is optionally covered by a soft pliable rubber or plastic material. Leg support 60 is moveable from a vertical position as shown in FIG. 2 to a horizontal position as shown in phantom by a leg support hydraulic cylinder. As best seen in FIG. 2, one end of the leg hydraulic cylinder 70 is attached to stop 46. The remaining end has a connecting rod 77 extending therefrom which is connected to the leg support. The cylinder has piston 72 therein with fluid, for example water, located on either side thereof. A fluid feedline 74 feeds the back end of the hydraulic cylinder thereby raising leg support 60 to a horizontal position. Upon movement of the master control switch 80 to another position, fluid is fed through line 75 to the front portion of the hydraulic cylinder thereby causing the leg support to be lowered.

Master control switch or universal valve 80 can be of any conventional construction so long as it has at least one neutral position and four functional positions. Two of the functional positions relate to rising and lowering seat assembly 40 in a manner as noted above. The remaining two functions relate to raising and lowering the leg support in a manner as noted above.

The operation of bathing apparatus 10 is as follows. Stanchion 20 is installed in place adjacent to but spaced apart from a bathing receptacle such as a bathtub by securing floor support 22 to a floor and ceiling plate 38 to a ceiling. Water pressure form a suitable source such as a pipe leading to a water closet is attached to universal control switch 80. The various hydraulic cylinders can then be rendered operational as by filing the same with water and purging air therefrom. The bathing apparatus is swung to a position outside of the bathtub and seat assembly through the master control switch is raised or lowered to a desirably height. The handicapped or physically impaired person is then seated.

Upon operation of master control switch 80, leg support 60 is hydraulicly raised into a horizontal position. The bathing apparatus is then manually pivotal about stanchion 24 such that the bathing apparatus is positioned above a bathtub or other bathing receptacle. Upon activation of the appropriate function of the master control valve 80, the seat assembly is lowered into the bathtub. The person can then bath his or herself or through the assistance of another individual. Upon completion of bathing, master switch 80 is moved to another function whereby hydraulic cylinder 26 is activated so that the seat as well as the leg support are raised out of the bathtub. The person is then manually swung out from over the bathtub to a position aside the tub. Leg support 60 is then lowered by activating the proper function of the master control switch. The person is then removed from the bathing apparatus. Accordingly, a physically impaired or handicapped person can be effectively bathed without any lifting by another individual.

Inasmuch as the bathing apparatus is not directly attached to the bathing receptacle, the possibility of damage thereto is abated. The leg support further serves to raise a persons legs above the receptacle sidewall and prevent possible binding thereof.

Another important aspect of the present invention is that the entire bathing apparatus is foldable and can thus be folded-up and stored. That is, the seat bottom portion with leg support 60 in a horizontal position is pivotable about pivot pin 51 and can also be folded against the upper portion of frame 42. Arm rest 45 which is pivotable about pivot pin 47 can also be moved out of the way as can master control switch 80 which pivots about pivot pin 82. Since the bottom portion of seat frame 42 has a short traverse projection, the entire bathing apparatus occupies very little room and can be stored adjacent to stanchion 20. Upon use of bathing apparatus 10, the seat portion, the arm rest and the master control switch are merely lowered into position. An appropriate function of the master control switch is then initiated to lower leg support 60 into a vertical position.

While in accordance with the patent statutes a best mode and preferred embodiment have been set forth, the scope of the invention is not limited thereto, but rather by the scope of the attached claims.

What is claimed is:

1. A bathing apparatus for moving a person into and out of a bathing receptacle; comprising:

a stanchion, said stanchion mounted independently of the bathing receptacle, one end of said stanchion being securable to a floor and the remaining end of said stanchion being securable to a ceiling, a seat assembly, said seat assembly having a frame, said seat assembly frame pivotably attached to said stanchion, said stanchion having a means for raising and lowering said seat assembly, said stanchion means for raising and lowering said seat assembly being adjustably attached to said stanchion, a leg support, said leg support being pivotably connected to said seat assembly, a hydraulic cylinder, said hydraulic cylinder having one end thereof connected to said leg support and the other end thereof being connected to said seat assembly, said hydraulic cylinder capable of raising and lowering said leg support.

2. A bathing apparatus according to claim 1, including a seat bottom portion, said seat attached to said frame.

3. A bathing apparatus according to claim 1, including a seat bottom portion stop, said hydraulic cylinder connected to said seat bottom portion stop, and wherein said seat bottom stop engages said seat assembly frame.

4. A bathing apparatus according to claim 3, including a master fluid control switch, said master fluid control switch connected to said stanchion means for raising and lowering said seat assembly, and said master fluid control switch connected to said hydraulic cylinder.

5. A bathing apparatus according to claim 4, wherein said bathing apparatus is foldable.

6. A bathing apparatus for lifting a person in and out of a bathing receptacle; comprising:

a stanchion having a vertical axis, a seat assembly having a frame and a seat portion, said frame pivotably attached to said stanchion about said vertical axis, said stanchion having a hydraulic cylinder for raising and lowering said seat assembly;

a leg support, said leg support pivotably attached to said seat assembly, a leg hydraulic cylinder, said leg hydraulic cylinder attached to said seat assembly and to said leg support, said hydraulic cylinder capable of raising and lowering said leg support.

7. A bathing apparatus for lifting a person in and out of a bathing receptacle according to claim 6, wherein said stanchion is mounted separately and independently from the bathing receptacle.

8. A bathing apparatus for lifting a person in and out of a bathing receptacle according to claim 7, wherein said stanchion hydraulic cylinder and said leg hydraulic cylinder are operable by pressurized water, and wherein said bathing apparatus is foldable.

* * * * *